United States Patent [19]

Wood

[11] Patent Number: 4,894,812

[45] Date of Patent: Jan. 16, 1990

[54] REMOVABLE AND REUSABLE CAP WITH TIMEPIECE FOR A MODIFIED DISPOSABLE CIGARETTE LIGHTER

[76] Inventor: Eddie M. Wood, 6322 N. 47th Ave., Glendale, Ariz. 85301

[21] Appl. No.: 372,774

[22] Filed: Jun. 29, 1989

[51] Int. Cl.[4] ..... G04B 27/00; F23Q 2/32

[52] U.S. Cl. ..... 368/10; 431/253

[58] Field of Search ..... 368/10, 278; 206/234; 431/13, 15, 25, 125, 132, 135, 253, 255, 144, 146, 156

[56] References Cited

U.S. PATENT DOCUMENTS

| | | | |
|---|---|---|---|
| D. 175,085 | 7/1955 | Lowenthal | D 48/27 |
| D. 256,237 | 2/1980 | Vong | D14/68 |
| 2,576,476 | 11/1951 | Peter et al. | 368/278 |
| 2,577,679 | 12/1951 | Fraser | 58/80 |
| 4,092,096 | 5/1978 | Goto | 431/253 |
| 4,094,140 | 6/1978 | Ohue et al. | 368/10 |
| 4,102,631 | 7/1978 | Goto | 431/253 |
| 4,209,977 | 7/1980 | Yoshinaga | 368/10 |
| 4,368,030 | 1/1983 | Benedetti | 431/13 |
| 4,478,330 | 10/1984 | Lin | 206/234 |
| 4,769,799 | 9/1988 | Matsukage | 368/278 |

*Primary Examiner*—Vit W. Miska

[57] ABSTRACT

A combination disposable cigarette lighter and disposable cigarette lighter cap with timepiece wherein said cap with timepiece may be easily installed on said lighter by hand, and removed from said lighter by hand when the fuel is exhausted in said lighter, and reinstalled on any number of subsequent lighters, thereby allowing an individual the opportunity to keep a timepiece and a disposable cigarette lighter combination on or about his or her person at such times as they may deem necessary.

5 Claims, 1 Drawing Sheet

REMOVABLE AND REUSABLE CAP WITH TIMEPIECE FOR A MODIFIED DISPOSABLE CIGARETTE LIGHTER

FIELD OF THE INVENTION

The invention relates to a removable and reusable cap with a timepiece for use with a disposable cigarette lighter.

BACKGROUND OF THE INVENTION

Refuelable cigarette lighters with timepieces have been in existence for many years. See for example, U.S. Pat. No. 2,576,476, issued to A. Peter et al. on Nov. 27, 1951, including a wind-up timepiece. The timepiece is movable in the lighter assembly for purposes of periodic winding and setting of the timepiece.

On Dec. 4, 1951, U.S. Pat. No. 2,577,679 was issued to Fraser. It shows a similar conbination wherein the actuator for the lighter ignition is also used to wind the timepiece.

U.S. Design Pat. No. Des. 175,085, issued to Lowenthal on July 5, 1955, shows a cigarette lighter incorporating a removable timepiece at the bottom front portion of the lighter. The timepiece was probably removable to facilitate the refueling of the lighter although this is not explained.

U.S. Pat. Nos. 4,092,096 and 4,102,631, were issued to Goto on May 30, 1978 and July 25, 1978, respectively. The patents issued to Goto relate to solution of the noise problems inherent in an assembly which includes a battery operated electronic watch and an electonic ignition system for a gas fueled cigarette lighter, and to an integrated switching system for lighter ignition and watch control.

U.S. Pat. No. 4,094,140, issued to Ohue et al. on June 13, 1978, and Pat. No. 4,209,977, issued to Yoshinaga on July 1, 1980, show refuelable cigarette lighters which include a digital timepiece. However both timepieces are incorporated in the body of the lighter and not in the cap.

U.S. Design Pat. No. Des. 256,237, issued to Vong on Aug. 5, 1980, claims to show a "Combined Radio, Watchcase and Lighter". It does not appear that this invention is intended to be disposable.

U.S. Pat. No. 4,368,030, issued to Benedetti on Jan. 11, 1983, shows a combination counter and timer which is combined with a cigarette lighter for the purpose of counting and displaying the number of times the lighter is used and the elapsed time between the last two uses.

U.S. Pat. No. 4,769,799, issued to Matsukage on Sept. 6, 1988, shows a watch intended for mounting on a variety of different objects. Emphasis is placed on mounting the watch on articles of clothing, although other applications are also indicated. Although this patent does not combine the timepiece with a cigarette lighter, it did show-up in the patent search and I felt that it should be included in this application.

In recent years, disposable cigarette lighters have preempted a large portion of the market for cigarette lighters. These lighters are manufactured from very low cost elements and invariably utilize plastic cases which are injection molded. None of the parts of these lighters are replaceable; the lighter is intended for discard when the initial fuel supply is exhausted. The sale price to the consumer is extremely low to provide further incentive to discard the lighter upon exhaustion of the non-refillable fuel tank. It is questionable whether an integral timepiece could be provided at a low enough cost to economically warrant disposal of a lighter which included such a timepiece. It is believed that this is the reason why no such combination of timepiece and disposable lighters have appeared on the market. On the other hand, the earlier inventions described in the prior art indicate a long feld need for such a combination device.

SUMMARY OF THE INVENTION

The economic problem related to inclusion of a reliable timepiece with a disposable cigarette lighter is resolved according to the instant invention by combining the disposable lighter with a removable and replaceable timepiece which may be replaced on a substitute disposable lighter upon exhaustion of the fuel in each predecessor lighter, so that the relatively high cost of the timepiece may be amortized over a more reasonable use period. This is accomplished in such a way as to present the appearance of an integrated unity, but the removal and reinstallation of the timepiece may be accomplished without any tools; it is accomplished only by use of the operator's hands.

It is, therefore, the object of the invention to provide a removable, and reusable cap with a timepiece for use with a disposable cigarette lighter equipped with cooperating devices for holding and pivoting said cap upon said lighter.

The foregoing and other objects of the invention will be more readily understood upon study of the Detailed Description of the Invention which follows, together with the drawings, in which.

DETAILED DESCRIPTION OF THE PREFERRED EMBODIMENT OF THE INVENTION

Figure 1:
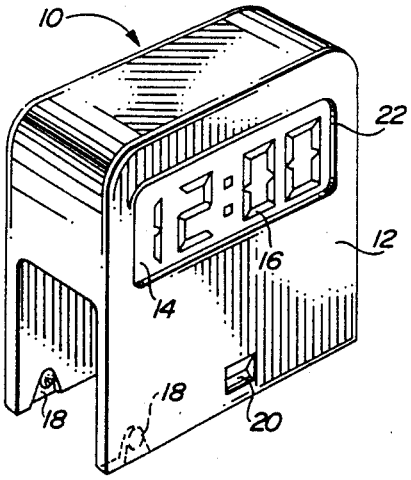
FIG. 1 is a perspective view of the invented cap and timepiece assembly.

FIG. 1 shows the preferred embodiment of the invention in perspective view. Assembly 10 comprises a metal cap 12 equipped with opening 22 to securely hold timepiece holder 14 which securely holds timepiece 16. Cap 12 is also equipped with cooperating retaining device 20 and cooperating pivoting device 18.

Figure 2:
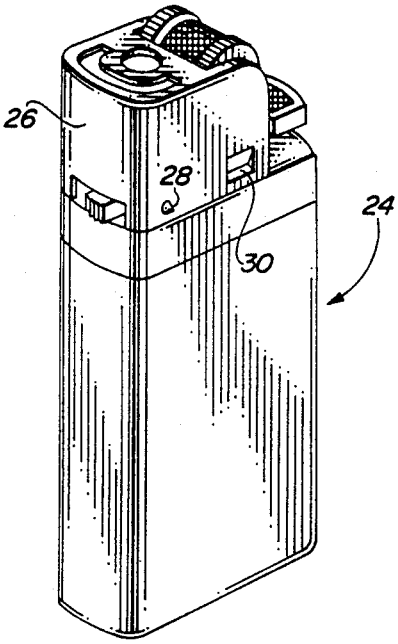
FIG. 2 is a perspective view of a disposable cigarette lighter with cooperating devices for securely holding cap in place while still allowing it to pivot.

FIG. 2 shows a perspective view of a modified disposable cigarette lighter 24 which comprises cooperating holding device 30 and cooperating pivoting device 28, both punched or pressed into metal band 26.

Figure 3:
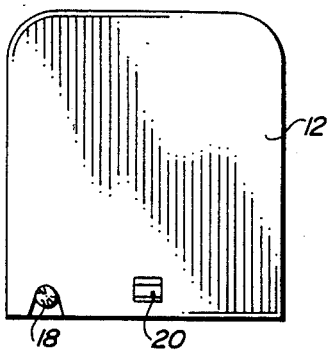
FIG. 3 is an inside view of the back portion of the invention of FIG. 1 showing cooperating holding and pivoting devices.

FIG. 3 is an inside view of the back portion of the invention of FIG. 1 showing cooperating holding device 20 and cooperating pivoting device 18, both punched or pressed into metal cap 12.

Figure 4:
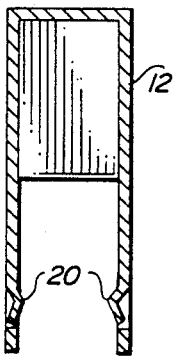
FIG. 4 is a section view of the invention of FIG. 1 showing a more detailed view of the locking device which holds the cap firmly to the lighter.

FIG. 4 is a section view of the invention of FIG. 1 showing cap 12 with a more detailed view of holding device 20. These flanges will be pressed or punched into the metal cap 12 much the same way flange 30 is presently being pressed or punched into metal band 26 by many lighter manufacturers.

Figure 5:
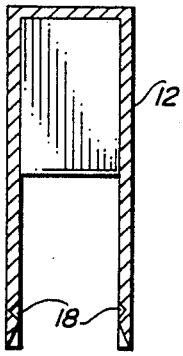
FIG. 5 is another section view of the invention of FIG. 1 showing a more detailed view of the pivoting device which also helps hold the cap in place and makes it possible for the cap to be opened to use the lighter for the purpose it was intended.

FIG. 5 is another section view of the invention of FIG. 1 showing cap 12 with a more detailed view of pivoting device 18. The rounded indentation (part of device 18) on the inside of cap 12 is to be manufactured to cooperate exactly with protrusion 28 on band 26, providing pivoting action. The slightly tapered and beveled indentation (also part of device 18) leading to the rounded indentation is to facilitate easy insertion of the lighter assembly 24 into the cap assembly 10.

Figure 6:
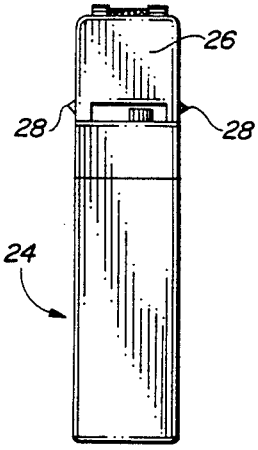
FIG. 6 is a side view of the invention of FIG. 2 showing a more detailed view of the cooperating pivoting device on the disposable lighter.

FIG. 6 is a side view of the invention of FIG. 2 showing a modified disposable cigarette lighter 24 with a more detailed view of cooperating pivoting device 28 punched or pressed into metal band 26. Of course, one of ordinary skill in the art will understand the cooperating action of protrusion 28 and indent device 18 to form a pivoting action for cap assembly 10. (It should be noted that no claim is being made for cooperating device 30 of modified lighter 24 in FIG. 2. This particular feature is presently employed in many disposable lighters. Device 30 is punched or pressed into metal band 26 for the purpose of holding said band to said disposable lighter.)

It will also be understood by those skilled in the art that disposable lighter cap 12 will probably be formed from a flat piece of metal with all necessary punching and/or pressing of pivoting device 18, holding device 20, and opening 22 performed while in this flat stage and subsequently formed into the invention shown in FIG. 1.

It will further be understood by those skilled in the art that timepiece holder 14 could be pressed into opening 22 and secured by the close proximity of timepiece holder 14 and opening 22. Timepiece holder 14 could also be glued to the inside of disposable lighter cap 12. The preferred materials for timepiece holder 14 should be metal or plastic.

While the invention has been particularly shown and described herein with reference to a preferred embodiment thereof it will be understood by those skilled in the art that various other modifications and changes may be made to the present invention from the principles of the invention as herein described without departing from the spirit and scope as encompassed in the accompanying claims. For example, it may become possible to manufacture timepieces other than digital electronic timepieces, as shown herein, more economically than at present. These new timepieces could then be used competitively in the system of the invention. The invention could also be made of materials other than metal, such as injection molded plastic, still providing the same purpose and function as the preferred choice of metal. Therefore it is intended in the appended claims to cover all such equivalent variations which may come within the scope of the invention as described.

What is claimed is:

1. A disposable cigarette lighter and disposable cigarette lighter cap comprising:

a disposable cigarette lighter;

a disposable cigarette lighter cap with timepiece, with cooperative means for holding said timepiece to said cap, and cooperative means for pivoting and holding said cap on said lighter in apparent integrated unity, and cooperative means for removing said cap from said lighter simply by pulling said cap from said lighter.

2. The disposable cigarette lighter and disposable cigarette lighter cap with timepiece according to claim 1 wherein said cooperative means for pivoting said cap on said lighter further comprises:

indent means cooperatively disposed in said cap, and protrusion means cooperatively disposed on said lighter for purposes of easy insertion of said lighter into said cap, and for means of pivoting said cap on said lighter for purpose of lighting said lighter.

3. The disposable cigarette lighter cap with timepiece according to claim 1 wherein said cooperative means for holding said cap to said lighter further comprises:

indent means for releasably locking said cap to said lighter for stability.

4. The disposable cigarette lighter cap with timepiece according to claim 1 wherein said means for holding said timepiece to said cap is located in the upper half of said cap.

5. The disposable cigarette lighter cap with timepiece according to claim 1 including a holder containing said timepiece disposed in said means for holding said timepiece to said cap and located in the upper half of said cap to prevent contact with any part of the lighter.

* * * * *